US008847498B2

(12) United States Patent
Chen et al.

(10) Patent No.: US 8,847,498 B2
(45) Date of Patent: Sep. 30, 2014

(54) RESONANT DAMPING CIRCUIT FOR TRIAC DIMMABLE

(75) Inventors: Timothy Chen, Aurora, OH (US); Haiyan Wang, Solon, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 190 days.

(21) Appl. No.: 13/473,559

(22) Filed: May 16, 2012

(65) Prior Publication Data

US 2013/0307417 A1 Nov. 21, 2013

(51) Int. Cl.
*H05B 37/02* (2006.01)

(52) U.S. Cl.
USPC ..... 315/125; 315/225; 315/224; 315/194; 315/291; 315/307

(58) Field of Classification Search
CPC ..... H05B 33/0848; H05B 33/08234; H05B 41/0875; H05B 41/0884; H05B 41/2921; H05B 41/2923; H05B 41/2926; H05B 41/2928; H02M 2001/0009; H02M 2001/42
USPC ..... 315/215, 225, 247, 209 R, 291, 307, 315/158, 210, 250; 323/241, 285
See application file for complete search history.

(56) References Cited

U.S. PATENT DOCUMENTS 4,665,323 A * 5/1987 Russell et al. ..... 307/75
7,777,423 B2 8/2010 Fischer et al.
8,575,901 B2 * 11/2013 Chang et al. ..... 323/241
8,610,363 B2 * 12/2013 Otake et al. ..... 315/194
2009/0187925 A1 * 7/2009 Hu et al. ..... 719/327
2010/0327773 A1 * 12/2010 Gu et al. ..... 315/307
2011/0025217 A1 2/2011 Zhan et al.
2012/0025729 A1 * 2/2012 Melanson et al. ..... 315/224
2012/0268031 A1 * 10/2012 Zhou et al. ..... 315/291

FOREIGN PATENT DOCUMENTS

DE 102005018795 10/2006
EP 2271181 1/2011
EP 2302980 3/2011
WO 2011/137646 11/2011

OTHER PUBLICATIONS

PCT, International Search Report, International Application No. PCT/US2013/033327 (Jul. 25, 2013).

* cited by examiner

*Primary Examiner* — Vibol Tan
(74) *Attorney, Agent, or Firm* — Thompson Hine L.L.P.

(57) ABSTRACT

A driver circuit for driving an LED includes a rectifier circuit to receive AC voltage and to convert the AC voltage to DC voltage. The driver circuit further includes a filter circuit for filtering the DC voltage. The driver circuit further includes a detection circuit for determining a change in the filtered DC voltage over a predetermined time interval. The driver circuit further includes a dampening circuit for dampening the filtered DC voltage responsive to the detection circuit determining that the change in filtered DC voltage over the predetermined time interval exceeds a predetermined threshold.

14 Claims, 3 Drawing Sheets

RESONANT DAMPING CIRCUIT FOR TRIAC DIMMABLE

FIELD OF DISCLOSURE

The present disclosure relates to the field of power supply devices. More particularly, the present disclosure relates to alternating current ("AC") dimming circuit compatible drivers for lighting devices.

BACKGROUND

Triac dimmer circuits are commonly installed in homes and commercial establishments throughout the United States as they are inexpensive and efficient devices with which to effect lamp dimming. A triac dimmer installed in series with a power supply and an incandescent lamp in a light circuit controls how much power is delivered to a lamp and thereby how brightly the lamp shines. The triac dimmer cuts out a portion of the supplied AC power waveform, allowing only a portion of the supplied power to pass to the lamp, depending on the setting of the triac dimmer. In other words, the triac dimmer "chops" the supplied voltage. In an incandescent lamp, the thermal inertia of the glowing lamp filament smoothes the resulting pulses of power into a consistent light output consistent with the average power of the pulses. Thus, a user is able to dim an incandescent lamp to a desired brightness by adjusting the triac dimmer.

Modern energy efficient lighting systems are gradually supplanting the venerable incandescent lamp. Varieties of fluorescent and semiconductor lighting systems such as compact fluorescent lamps (CFLs) and light emitting diode lamps (LEDs) made in form factors and light outputs to function as replacement lamps for incandescent lamps, fitting into the same sockets with no more effort than is ordinarily required to change a light bulb. These modern replacement lamps are growing rapidly in popularity due to greatly increased energy efficiency and lamp life over that of the incandescent lamp.

However, the chopping action of a triac dimmer causes sharp transitions, or edges in the voltage of the AC power waveform. These changes, easily evened by thermal inertia in an incandescent lamp, may adversely affect the performance of modern energy efficient replacement lamps. The edges can cause the lamp to flicker, strobe, or dim inaccurately. Furthermore, the edges are harsh on the more complex circuits of modern energy efficient replacement lamps. Coupling a modern energy efficient lighting system with an AC dimming circuit may result in undesirable effects. Thus, modern energy efficient incandescent replacement lamps, such as CFLs and LEDs must contain circuitry adapted to handle the triac dimming waveform.

SUMMARY OF THE DISCLOSURE

A driver circuit for driving an LED includes a rectifier circuit to receive AC voltage and to convert the AC voltage to direct current ("DC") voltage. The driver circuit further includes a filter circuit for filtering the DC voltage. The driver circuit further includes a detection circuit for determining the change in the rectified DC voltage over a predetermined time interval. The driver circuit further includes a dampening circuit for dampening the filtered current responsive to the detection circuit determining that the change in rectified DC voltage over the predetermined time interval exceeds a predetermined threshold.

A dimmable LED circuit includes an LED, a triac dimmer, and a dimmable drive circuit for delivering power from the dimmable power supply directly to the LED. The dimmable direct drive circuit includes a rectifier circuit to convert the AC voltage, supplied by the triac dimmer, to DC voltage. The dimmable direct drive circuit further includes a filter circuit for filtering the DC voltage. The dimmable direct drive circuit further includes an edge detection circuit for detecting an edge transition in a chopped waveform by determining that the change in the filtered DC voltage over a predetermined time interval exceeds a predetermined threshold. The dimmable direct drive circuit further includes a dampening circuit for dampening the resonant of the rectified DC voltage.

BRIEF DESCRIPTION OF THE DRAWINGS

In the accompanying drawings, structures are illustrated that, together with the detailed description provided below, describe exemplary aspects of the present teachings. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1:
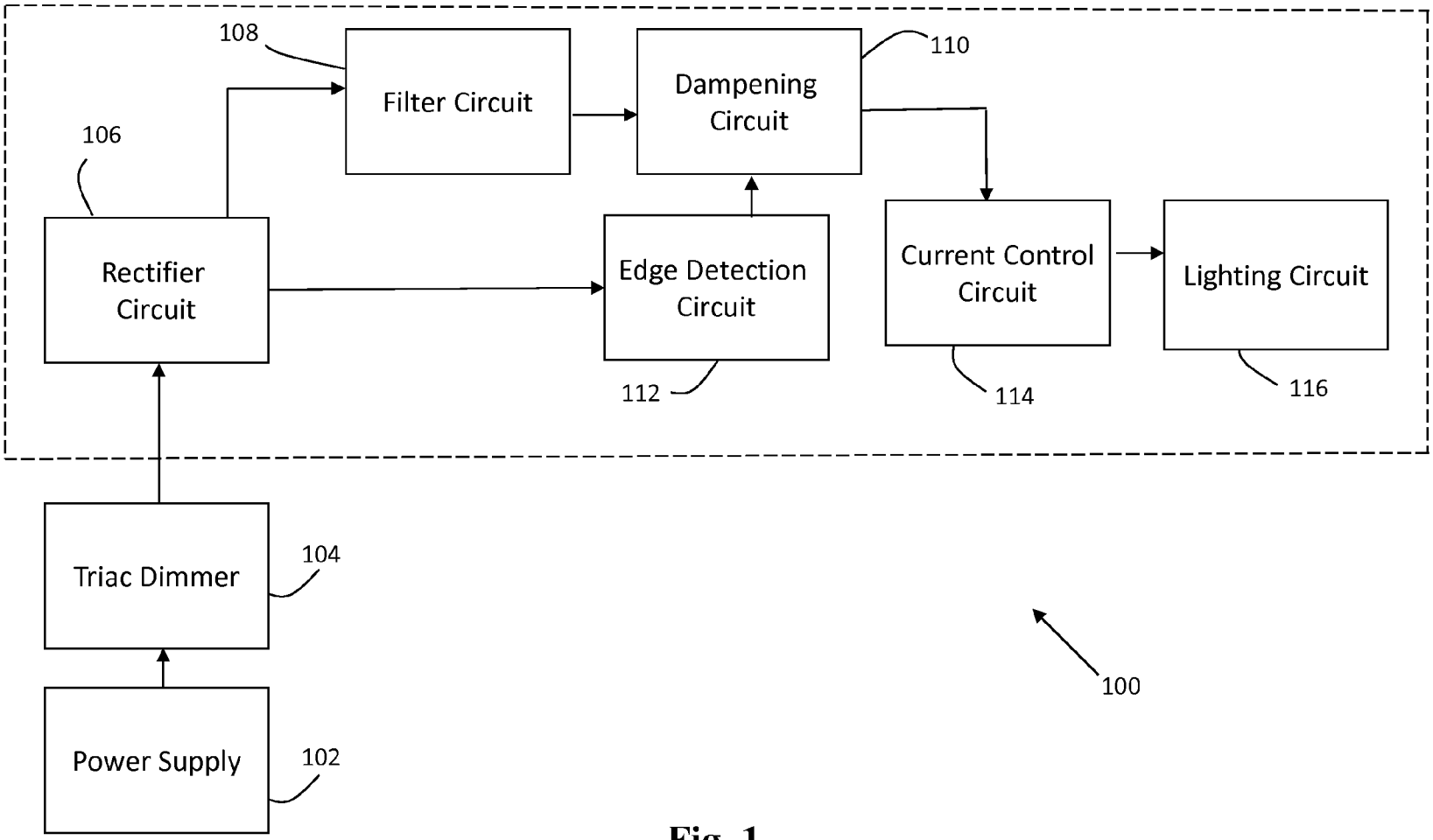
FIG. 1 illustrates an example resonant damping circuit for triac dimmable driver for powering a lamp.

FIG. 1 illustrates an example resonant damping circuit for triac dimmable driver 100 (hereinafter referred to as drive circuit) for powering a lamp. Drive circuit 100 is configured to connect to triac dimmer 104 which is adjusted by a user to regulate the amount of power being delivered from power supply 102 to lighting circuit 116. Drive circuit 100 receives alternating current voltage from power supply 102, via triac dimmer 104.

Drive circuit 100 has a rectifier circuit 106 for rectifying the received current to pulsed direct current. In other words, rectifier circuit 106 converts AC received from triac dimmer 104 to pulsed DC. In an example embodiment, rectifier circuit 106 is a four diode bridge rectifying circuit.

Drive circuit 100 has a filter circuit 108 for filtering the current received from power supply 102 and for providing filtered current to lighting circuit 116. Filter circuit 108 filters out high frequency content and therefore prevents electromagnetic interference to other devices.

Figure 2:
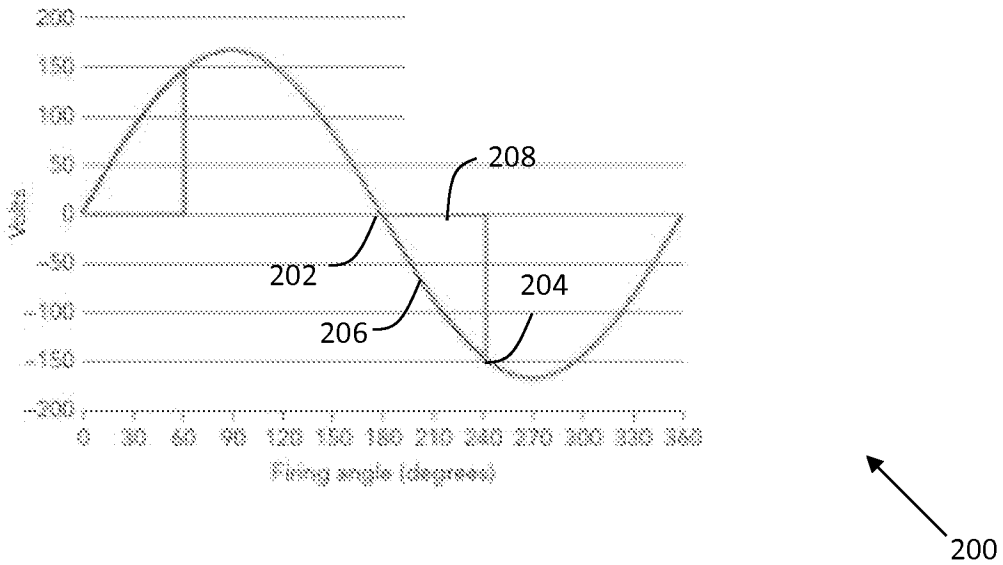
FIG. 2 is a graph illustrating an example chopped AC waveform produced by a triac-based dimmer control circuit.

Drive circuit 100 has an edge detection circuit 112 for detecting sharp transitions or edges in the waveform provided by triac dimmer 104. FIG. 2 illustrates an example phase controlled or chopped AC waveform 200 produced by triac dimmer 104. Because the waveform is chopped, or cut, between points 202 and 204, the result is a sharp transition in voltage between the two points. Specifically, rather than smoothly transitioning from 0 volts to −150 volts along a curve 206 as would be the case in a full wave form, the chopped wave form sharply transitions directly from 0 volts to −150 volts in a single step 208. Edge detection circuit 112 detects such voltage steps or sharp transitions.

Referring back to FIG. 1, drive circuit 100 has a dampening circuit 110, or an active controlled snubber, to dampen, or reduce, the resonant of filter circuit 108 due to sharp transitions in power being supplied to filter circuit 108. Dampening helps prevent drive circuit 100 current from oscillating during edge transitions which in turn helps stabilize lighting circuit 116, which helps prevent flickering.

In one example, edge detection circuit 112 detects an edge or sharp transition by determining that the change in filtered DC voltage over the predetermined time interval exceeds a predetermined threshold. In one example, edge detection circuit 112 includes a comparator circuit 120 to compare the rectified DC voltage with a reference voltage in order to detect an edge. For example, edge detection circuit 112 may detect a step increase in voltage from 0 volts to −150 volts (dv/dt) and determine that the step increase is an edge after comparing the voltage to a known reference point based on a standard, or non-chopped, waveform.

In one example, edge detection circuit 112 is a fixed delay circuit configured to enable dampening circuit 110 for a fixed time interval.

In one example, edge detection circuit 112 is an adaptive delay circuit configured to enable dampening circuit 110 for a variable time interval, based on a waveform of the DC voltage provided by rectifying circuit 106.

In one example, drive circuit 100 includes a current control circuit 114 to regulate the amount of power being delivered to lighting circuit 116 by drive circuit 100. In one example, current control circuit 114 includes a comparator circuit 122, or a control circuit, to compare, or regulate, an output current provided by filter circuit 108 to lighting circuit 116 with a reference voltage and regulates the amount of power being delivered to lighting circuit 116 based on the comparison, or control.

Figure 3:
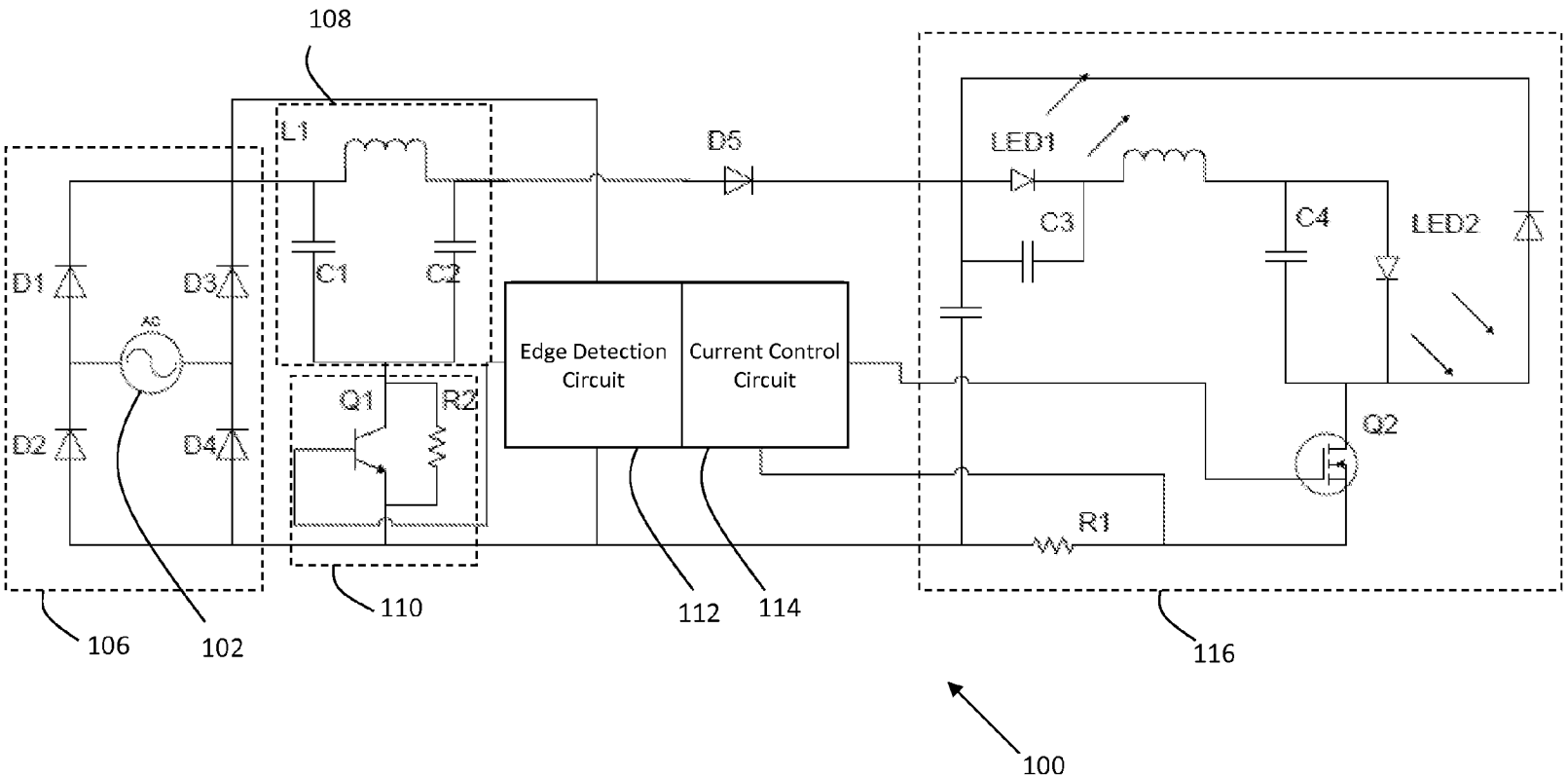
FIG. 3. illustrates in more detail the example resonant damping circuit for triac dimmable driver for powering a lamp of FIG. 1.
Figure 1:
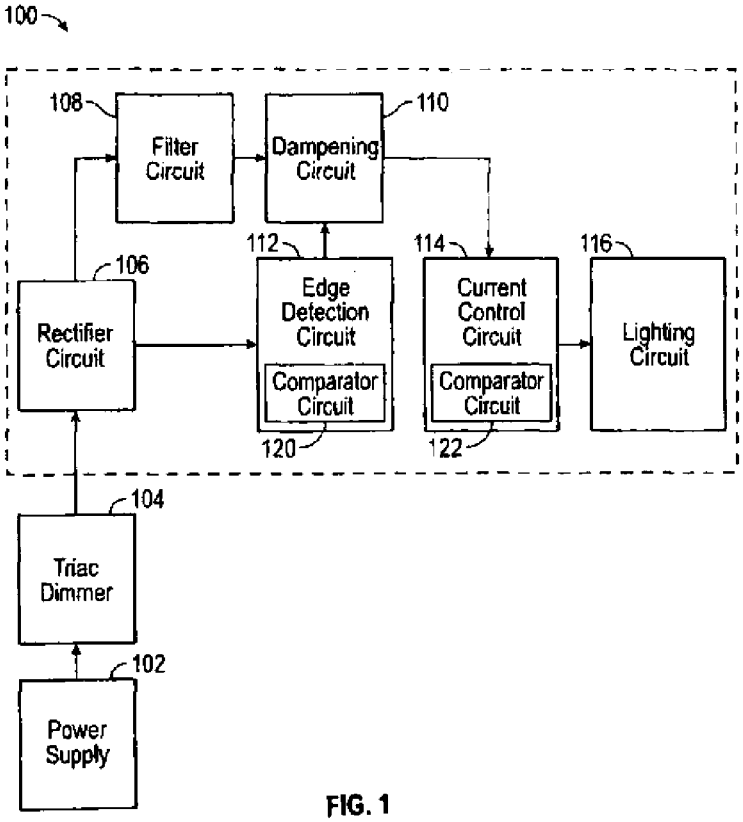

FIG. 3 illustrates in more detail the example drive circuit 100 for powering a lamp of FIG. 1. Rectifier circuit 106 is connected in series with power supply 102. Rectifier circuit 106 includes diodes D1, D2, D3, and D4. The four diodes combine to form a four bridge diode circuit for converting supplied AC voltage to rectified DC voltage.

Filter circuit 108 is connected in series with rectifier circuit 106. Filter circuit 108 includes capacitors C1 and C2 and inductor L1.

Dampening circuit 110 is connected in series with filter circuit 108. Dampening circuit 110 includes a transistor switch Q1 connected in parallel with a dampening resistor R2. An output of edge detection circuit 112 is connected to a base of transistor switch Q1. Thus, edge detection circuit 112 is configured to switch the transistor switch Q1 to enable dampening resistor R2 to dampen the current provided to filter circuit 108.

Lighting circuit 116 includes a resistor R1 to provide current control circuit 114 with a measurement point for detecting the current being provided to LED1 and LED2 in lighting circuit 116. Lighting circuit 116 further includes a Mosfet Q2. Output of current control circuit 114 is connected to a gate of Mosfet Q2. Current control circuit 114 is configured to turn on and off Mosfet Q2 to regulate the amount of current and therefore power being delivered to LED1 and LED2 by drive circuit 100.

Lighting circuit 116 further includes a storage capacitor C3 connected in parallel with LED1 and a storage capacitor C4 connected in parallel with LED2. Storage capacitors C3 and C4 store energy in parallel to LED1 and LED2 respectively.

Drive circuit 100 achieves increased efficiency and eliminates isolation by providing power directly from power supply to load. In applications wherein the drive circuit 100 drives lighting elements, the lighting element is dimmable by conventional AC dimming circuits, and demonstrates flicker-free stability in light output at all dimming levels, as well as a broadened range of dimmability. Specifically, drive circuit 100 has a full range of dimming on an AC dimming circuit, from 100-0% of lumen output, in close corroboration with operation of the AC dimming control. In addition, drive circuit 100 delivers a constant current to a load when powered by AC current exhibiting a non-conventional waveform.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of example aspects of the present disclosure thereof, and while the example aspects have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A driver circuit for driving an LED, comprising:

a rectifier circuit to receive AC voltage and to convert the AC voltage to DC voltage;

a filter circuit for filtering the DC voltage;

a detection circuit having an output, the detection circuit for determining a change in the rectified DC voltage over a predetermined time interval; and a dampening circuit comprising a transistor having a base and a damping resistor, the transistor connected in parallel with the dampening resistor and the output of the detection circuit connected to the base of the transistor, the damping circuit for dampening filtered current responsive to the detection circuit determining that the change in rectified DC voltage over the predetermined time interval exceeds a predetermined threshold, the dampening circuit connected in parallel with the filter circuit, and the detection circuit configured to switch the transistor to enable the dampening resistor to dampen the filtered current.

2. The driver circuit of claim 1, wherein the detection circuit is a fixed delay circuit configured to switch the transistor to enable the dampening resistor for a fixed time interval.

3. The driver circuit of claim 1, wherein the detection circuit is an adaptive delay circuit configured to switch the transistor to enable the dampening resistor for a variable time interval, based on a waveform of the rectified DC voltage.

4. The driver circuit of claim 1, wherein the detection circuit comprises a comparator circuit to compare the rectified DC voltage with a reference voltage.

5. The driver circuit of claim 1, further comprising a current control circuit to regulate the amount of power being delivered to an LED by the driver circuit.

6. The driver circuit of claim 5, wherein the current control circuit includes a comparator to compare an output current delivered to the LED with a reference current and wherein the current control circuit regulates the amount of power being delivered to the LED based on the comparison.

7. The driver circuit of claim 5, wherein an output of the current control circuit is connected to a gate of a transistor, and wherein the current control circuit is configured to switch the transistor to regulate the amount of current being delivered to the LED by the driver circuit.

8. A dimmable LED circuit, comprising:

an LED;

a triac dimmer; and a dimmable drive circuit for delivering power from the dimmable power supply directly to the LED, comprising:

a rectifier circuit to convert the AC voltage, supplied by the triac dimmer, to DC voltage;

a filter circuit for filtering the DC voltage;

an edge detection circuit having an output, the edge detection circuit for detecting an edge transition in an input waveform by determining that a change in the filtered DC voltage over a predetermined time interval exceeds a predetermined threshold; and a dampening circuit comprising a transistor having a base and a damping resistor, the transistor connected in parallel with the dampening resistor and the output of the edge detection circuit connected to the base of the transistor, the damping circuit for dampening the resonant of rectified DC voltage and connected in series with the filter circuit, the detection circuit configured to switch the transistor to enable the dampening resistor to reduce the resonant of an input current.

9. The power circuit of claim 8, wherein the edge detection circuit is a fixed delay circuit configured to switch the transistor to enable the dampening resistor for a fixed time interval.

10. The power circuit of claim 8, wherein the edge detection circuit is an adaptive delay circuit configured to switch the transistor to enable the dampening resistor for a variable time interval, based on a waveform of the rectified DC voltage.

11. The power circuit of claim 8, wherein the edge detection circuit comprises a comparator circuit to compare the rectified DC voltage with a reference voltage.

12. The power circuit of claim 8, further comprising a current control circuit to regulate the amount of current being delivered to the LED by the power circuit.

13. The power circuit of claim 12, wherein the current control circuit includes a comparator to compare an output current delivered to the LED with a reference voltage and wherein the current control circuit regulates the amount of current being delivered to the LED based on the comparison.

14. The power circuit of claim 12, wherein an output of the current control circuit is connected to a base of a transistor, and wherein the current control circuit is configured to switch the transistor to regulate the amount of current being delivered to the LED by driver circuit.

* * * * *

UNITED STATES PATENT AND TRADEMARK OFFICE

CERTIFICATE OF CORRECTION

PATENT NO. : 8,847,498 B2
APPLICATION NO. : 13/473559
DATED : September 30, 2014
INVENTOR(S) : Timothy Chen and Haiyan Wang It is certified that error appears in the above-identified patent and that said Letters Patent is hereby corrected as shown below:

On the title page, item (54) and in the specification, column 1, lines 1-2

The Title reads:

"RESONANT DAMPING CIRCUIT FOR TRIAC DIMMABLE"

The Title should read:

-- RESONANT DAMPING CIRCUIT FOR TRIAC DIMMABLE DRIVER --

In the Drawings,

Sheet 1, Fig. 1 should appear as shown on the attached page

Signed and Sealed this
Tenth Day of November, 2015

Michelle K. Lee

Michelle K. Lee
*Director of the United States Patent and Trademark Office*